US007367805B2

(12) United States Patent
Renntoft

(10) Patent No.: US 7,367,805 B2
(45) Date of Patent: May 6, 2008

(54) TWO ALIGNING DEVICES AND AN ALIGNMENT METHOD FOR A FIRING SIMULATOR

(75) Inventor: Per Renntoft, Skillingaryd (SE)

(73) Assignee: Saab AB, Linköping (SE)

( * ) Notice: Subject to any disclaimer, the term of this patent is extended or adjusted under 35 U.S.C. 154(b) by 323 days.

(21) Appl. No.: 10/467,073

(22) PCT Filed: Feb. 7, 2002

(86) PCT No.: PCT/SE02/00203

§ 371 (c)(1),
(2), (4) Date: Aug. 5, 2003

(87) PCT Pub. No.: WO02/065044

PCT Pub. Date: Aug. 22, 2002

(65) Prior Publication Data

US 2004/0076928 A1 Apr. 22, 2004

(30) Foreign Application Priority Data

Feb. 15, 2001 (SE) ..... 0100497

(51) Int. Cl.
*F41G 3/26* (2006.01)

(52) U.S. Cl. ..... 434/22; 434/21

(58) Field of Classification Search ..... 463/22; 434/16–22, 26

See application file for complete search history.

(56) References Cited

U.S. PATENT DOCUMENTS 3,792,535 A 2/1974 Marshall et al.
3,932,702 A * 1/1976 Shelley et al. ..... 348/36
3,955,292 A * 5/1976 Robertsson ..... 434/22
4,038,757 A * 8/1977 Hicks et al. ..... 42/122
4,561,849 A * 12/1985 Eichweber ..... 434/22
4,619,616 A * 10/1986 Clarke ..... 434/22
4,695,256 A * 9/1987 Eichweber ..... 434/22
5,001,836 A 3/1991 Cameron et al.
5,060,391 A 10/1991 Cameron et al.
6,887,079 B1 * 5/2005 Robertsson et al. ..... 434/22

FOREIGN PATENT DOCUMENTS

WO WO2000/53993 * 6/2000
WO 00/53993 9/2000

* cited by examiner

*Primary Examiner*—Robert Pezzuto
*Assistant Examiner*—Travis Banta
(74) *Attorney, Agent, or Firm*—Venable LLP; Michael A. Sartori

(57) ABSTRACT

The invention concerns an aligning device for a simulator (105) arranged for firing and mounted on a weapon. The weapon has aiming means arranged to indicate the aiming of the weapon in a target area. The simulator is equipped with at least a first element arranged so as to emit an electromagnetic beam along a simulation axis, and adjusting means arranged so as to control the simulation axis in order to align the simulating axis with the aiming means. The device is characterized in that it has means (201) arranged so as to reflect visible light from the beam, and sighting means for alignment that are arranged so as to display a projection of the reflected light superimposed over an image (206) of the target area in an alignment sight window. The projected light is movable within the alignment sight window by means of adjusting means so as to enable placement of the projection at a point at which the aiming means are aimed.

17 Claims, 3 Drawing Sheets

TWO ALIGNING DEVICES AND AN ALIGNMENT METHOD FOR A FIRING SIMULATOR

TECHNICAL AREA

This invention concerns an aligning device for a simulator arranged for firing and mounted on a weapon, which weapon has aiming means arranged to indicate the aiming of the weapon in a target area, wherein the simulator is equipped with at least a first element arranged so as to emit an electromagnetic beam along a simulation axis, and adjusting means arranged so as to control the simulation axis to align the simulation axis with the aiming means.

The invention also concerns a method in connection with said aligning device.

STATE OF THE ART

In simulated firing with a laser, the simulator emits a laser beam, or an electromagnetic beam generated by means of a technology other than laser technology. This beam can be detected by one or more detectors mounted on one or more targets. The emitted beam, e.g. the laser beam, exhibits different intensities in different directions of radiation, which are known collectively as the "laser lobe". The simulated effect of a weapon being fired at the target is achieved when the radiance from the laser lobe exceeds, at one of the targets at a given distance and in a given direction from the simulator, a detection threshold of a detector on the target.

When a simulator is mounted on a weapon, the firing direction of the simulator must be aligned with the firing directing of the weapon. This can be accomplished by aiming the weapon with its regular sight at a target that is designed so as to be able to sense the simulated firing of the simulator. The simulator is fired, and the target is observed to determine the locations of the hits in relation to the aiming of the weapon. If deviations are present, the firing direction of the simulator is adjusted by means of an adjusting device built into the simulator until the weapon and the simulator are jointly aligned. It may also be necessary to repeat the alignment process if the simulator is jostled somewhat from its position, e.g. as a result of exposure to minor impacts.

WO00/53993 describes a simulator device mounted on a weapon equipped with a sight. A simulation beam is generated in the simulator along a simulation axis. The simulator also emits an alignment beam along an alignment axis that is parallel with the simulation axis or has a fixed and known angle relative to the simulation axis. The weapon sight defines an aiming axis that indicates the direction in which a round will leave the weapon when live ammunition is fired. To enable alignment of the simulation axis of the simulator with the aiming axis, e.g. a retroreflector prism is arranged so as to reflect the incident alignment beam along the alignment axis back into the sight along the aiming axis. The alignment beam is thus visible through the sight, so that the alignment axis and the simulation axis can be collectively adjusted using appropriate means so that they coincide with the sight axis.

However, the foregoing simulator device is capable of use only with types of weapons wherein the distance between the sight and a barrel on which the simulator is mounted is not so great that it becomes unfeasible in practice to reflect the alignment beam from the simulator back into the sight.

DESCRIPTION OF THE INVENTION

One purpose of the present invention is to handle the alignment of the simulation beam with an aiming axis that will also work for types of weapons in which the distance between the sight and the barrel precludes prior art solutions.

This has been achieved by means of an aligning device of the type described above, the design of which is independent of the distance between the sight and the barrel. The aligning device is characterized in that it has means arranged so as to reflect visible light from the beam, and sighting means for alignment arranged so as to display a projection of the reflected light in an alignment sight window, along with an image of the target area. With the weapon sight aimed at a target, it is thus possible to correct the aiming of the simulation axis using the adjusting means so that the projected light that is reflected in the sight window image is placed on the target. The sight window image is thus generated at a radial distance from the simulation axis, and thus from the simulating device, which distance is determined by the distance between the simulation axis and the axis parallel thereto. This distance is characteristically substantially shorter than the distance between the sight and the simulating device arranged on the weapon barrel. According to one embodiment in which the visible light is reflected along an axis parallel with the simulation axis, the sighting means include a first surface that is partially transparent to a beam within the visible wavelength spectrum and arranged so as to transmit the target area image to the sight window. The first surface also comprises a part of the reflecting means, wherein the surface is arranged so as to reflect at least a part of the visible light of the beam at the sight window in a direction coincident with the axis parallel with the simulation beam. The sight window may here consist of a virtual window in front of the first surface.

The reflecting means preferably include a second surface arranged along the simulation axis and in such a way as to reflect light within at least a part of the visible wavelength spectrum. In one embodiment the first and second surfaces are included in a retroreflector prism.

According to one embodiment, the sighting means include an element for magnifying the image displayed in the sight window, e.g. in the form of an alignment scope aimed at the first surface. The alignment precision can be improved as a result of the enlarged image provided by the alignment scope. In this embodiment the front lens of the alignment scope acts as the sight window.

According to one embodiment, the sighting means further include means for transferring the image shown in the sight window to a display site. The transferring means may include, e.g. a prism such as a pentaprism designed to reflect the target area image a number of times before the image leaves the prism to enter the opening of the alignment scope. Such a prism thus makes the aligning device more flexible, in that it is not necessary to keep the alignment scope pointed along the axis parallel to the simulation axis. If a prism designed to reflect the image an even number of times is used, the non-reversed image will be visible in the alignment scope. Here the surface of the prism that the image strikes first acts as the sight window. The transferring means may also include a mirror device arranged so as to reflect the image toward the alignment scope arranged, e.g. in connection with the aiming means.

A method for aligning the simulation axis with the aiming means associated with the aforedescribed aligning device involves aiming the weapon at a target in the target area while using the aiming means, and controlling the adjusting means so as to position the projection of the reflected light visible in the sight window within the image so that it essentially coincides with the target.

The invention offers a number of advantages over prior art technologies. The most important advantage is of course the fact that the invention also works for weapons types, such as cannon, in which the distance between the sight and the barrel precludes the use of prior art solutions. The aligning device according to the invention is moreover extremely robust, since it requires no precise adjustment during mounting prior to alignment, since all the components that do require precise mounting are fixedly mounted in the reflecting means.

PREFERRED EMBODIMENTS

Figure 1:
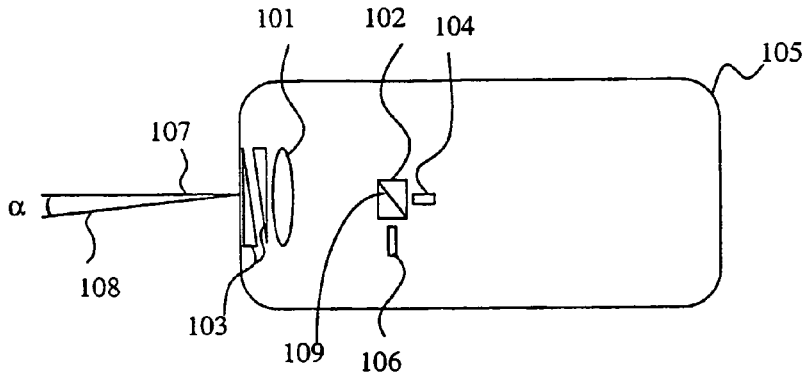
FIG. 1 shows an example of a firing simulator that is generating a simulation beam and an alignment beam.

In FIG. 1, a source 104 is arranged in a firing simulator 105 to generate a simulation beam in the form of an electromagnetic beam generated by laser technology or some other technology. For example, the simulation beam source 104 is an IR laser diode. There is also arranged in the simulator 105 a source 106 for generating an alignment beam. The alignment beam source 106 is characterized in that it emits radiation within the wavelength spectrum for visible light. In one example the alignment beam source 106 consists of a light-emitting diode (LED).

The firing simulator is arranged on a weapon, such as a cannon on a tank. The weapon is in turn equipped with a sight. The weapon sight defines an aiming axis, and it is this aiming axis that defines the direction in which a round will leave the weapon if live ammunition is fired. In the beam path of the simulation beam from the simulation beam source 104 there is arranged a beam splitter 102, whose beam-splitting layer 109 is arranged so as to let a substantial part of the simulation beam pass through to an optics system comprising a lens 101 and one or more optical wedges 103. The optics system will be described in greater detail below. The alignment beam source 106 is arranged relative to the simulation beam source 104 and the beam splitter 102 in such a way that, upon being reflected by the beam-splitting layer 109 of the beam splitter 102, the alignment beam departs the beam splitter along a simulation/alignment axis common with the simulation beam. In the embodiment shown in FIG. 1, the simulation beam source 104, the alignment beam source 106 and the beam splitter 102 are positioned relative to one another in such a way that both the simulation beam and the alignment beam strike the beam-splitting layer 109 at an angle of roughly 45 degrees, and so that the reflected alignment beam and the simulation beam passing through the beam-splitting layer thus travel toward the lens 101 of the optics system as a composite beam. This embodiment requires that the beam-splitting layer 109 be transparent to at least a part of the simulation beam while at the same time reflecting at least a part of the beam at the wavelength in which the alignment beam lies. An embodiment is also conceivable in which the positions of the simulation beam source 104 and the alignment beam source 106 are reversed, whereupon the reflecting/transmitting properties of the beam-splitting layer would have to be chosen accordingly.

An alignment beam source 106 is further arranged at an optical distance from the lens 101 so that the alignment beam is formed by the lens into a lobe, whereupon the lens 101 is designed to optimize said lobe. After the lens 101, the simulation beam and alignment beam will pass through the wedges 103, here in the form of a wedge pair that is rotatable to enable setting and adjustment of the alignment axis, and thus of the simulation axis as well. The beam axis 107 in FIG. 1 symbolizes a wedge setting such that the alignment beam, and thus also the simulation beam, departs the simulating device 1-5 in a direction straight out from the simulating device. An alternative setting of the wedges permits the alignment beam, and thus also the simulation beam, to depart the simulating device 105 along an axis 108 that has an angle $\alpha$ relative to the axis 107.

In an alternative example (not shown), the alignment beam source and the beam splitter are removed, whereupon the simulation beam source is aimed directly at the lens 101. In this embodiment the simulation beam source is preferably arranged so as to generate a laser beam within the visible wavelength spectrum in both a high-power setting (simulation setting) and a low-power setting (alignment setting), whereupon the simulation beam also functions as an alignment beam. Regardless of how the simulation and alignment beams are generated, it is assumed in the examples below that they are aimed along a common axis as they leave the simulator 105.

Figure 2:
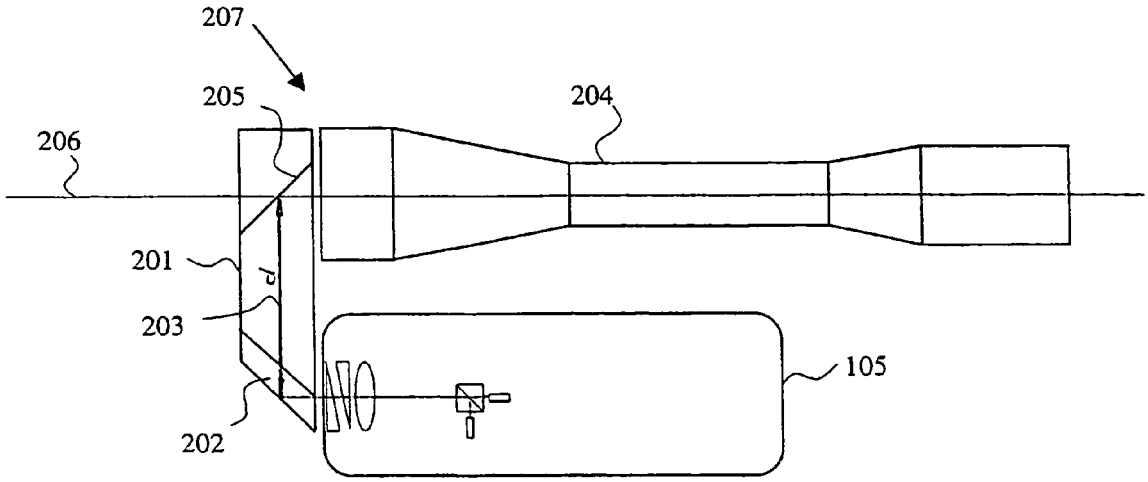
FIG. 2 shows an exemplary aligning device for the simulator described in FIG. 1.

In FIG. 2, reference number 207 designates an arrangement that is mounted to the simulator 105 in an alignment configuration. The simulation beam source 104 is preferably turned off in this alignment configuration. The arrangement 207 includes a retroreflector prism 201 arranged in front of the simulating device 105 and an alignment scope 204. One of the properties of the retroreflector prism is that it reflects at least a part of the incident beam in the same direction as the incident beam, but at a distance therefrom, which distance is determined by the size of the prism 201. The retroreflector prism characteristically consists of a roof prism 202 and a mirror 205 that is partially transparent to visible light. The roof prism 202 and the mirror 205 are arranged at a distance from one another and have mutually opposed reflecting surfaces with the same angle of inclination. An alignment beam 203 thus leaves the aforedescribed simulating device 105 at a given angel $\alpha$ relative to the axis 107 and is then reflected by the roof prism 202 located in the beam path of the alignment beam. The alignment beam reflected in the roof prism then strikes the mirror 205 and is reflected from same, whereupon the alignment beam reflected from the mirror 205 is directed at an angle $\alpha$ relative to the axis 107, but counter to the direction of the beam striking the roof prism 202. Because the retroreflector prism 201 is used, the beam traveling out from the prism 201 will be directed counter to the incident beam, regardless of the adjustment of the retroreflector prism, as long as the retroreflector prism is arranged in such a way that the beams can pass. The precision of the parallelism between the beam striking the prism and the outgoing beam is thus determined solely by the precision of the adjustment of the fixedly mounted components 202 and 205 in the retroreflector prism 201.

The alignment scope 204 is arranged in the beam path of the alignment beam reflected from the mirror 205. The mirror 205 which, as described above, is partially transparent to visible light, permits the passage of an image 206 of a target area behind the mirror while at the same time at least partially reflecting the alignment beam. The magnified image 206 is thus displayed in the alignment scope, with the alignment beam 203 being perceived as a spatially stable point in the continuously superimposed image 206. This point thus indicates where the simulation beam of the simulating device would be aimed if the simulation beam source were turned on. Alignment of the aiming of the simulation beam with the aiming axis of the weapon is achieved by first setting the weapon sight on a given target, or sighting mark, and then looking through the alignment scope 205 and rotating the alignment wedges 103 to zero the "alignment point" in the image 206 on the target. Note that the sole function of the scope is to magnify the image and increase the alignment precision. The alignment scope is not necessary on some weapons. As described above, the alignment scope 204 and the retroreflector prism 201 together form the alignment arrangement 207. The alignment arrangement 207 comprises a unit that is detachable from the weapon. It is of course not necessary for the scope 204 to be mounted at the reflector prism 201; it may instead be mounted on a separate frame arranged at the weapon, or quite simply held in the hand during use. The adjustment of the alignment scope 204 relative to the retroreflector prism is not critical to the alignment results.

We have now described the projection of the alignment beam as an alignment point. To ensure that this point will be as visible as possible in the image 206, the beam lobe of the alignment beam should be narrow, so that the point achieves a high intensity. Furthermore, the alignment beam should be at a wavelength such that the color of the point is in contrast to the color scale in the image 206. In one example, the alignment beam falls within the wavelength spectrum of visible red light.

Figure 3:
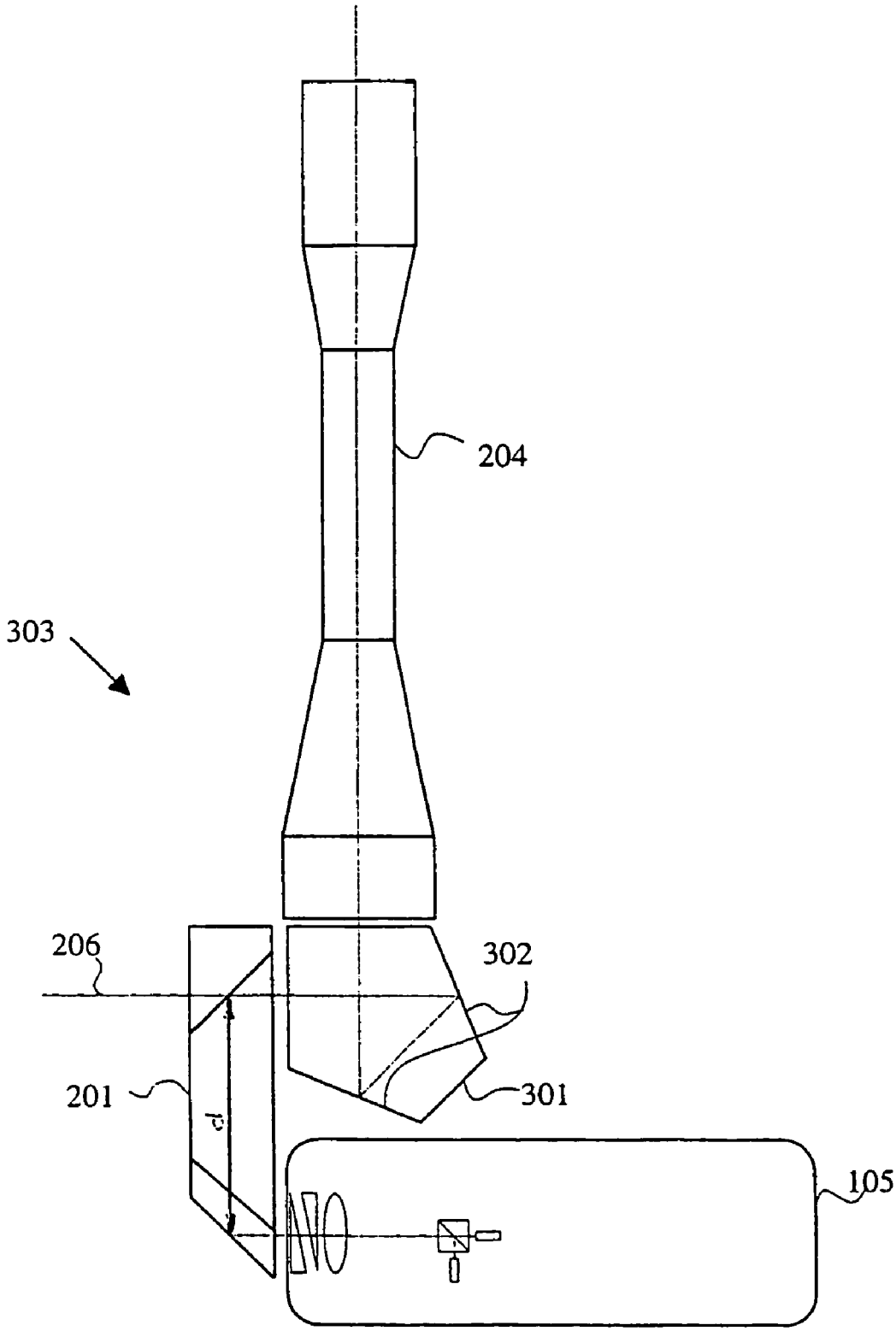
FIG. 3 shows an alternative aligning device.

It may not always be desirable or possible to arrange the alignment scope 204 axially with the aiming and simulation axes. FIG. 3 illustrates a simple alignment arrangement 303 that offers an alignment option wherein the scope is arranged radially vis-a-vis the aiming and simulation axes. The only difference from the embodiment depicted in FIG. 2 is that a pentaprism 301 is interposed between the retroreflector prism 201 and the alignment scope 204. The prism 301 is designed so that the image 206 superimposed over the projected alignment beam is reflected by two surfaces 302 of the prism 301, whereupon the image 206 remains non-reversed after having passed through the prism 301. In this embodiment, the surfaces 302 are arranged relative to one another in such a way that the outgoing beam is angled 90° relative to the incoming beam, so as to enable positioning of the alignment scope radially with the aiming axis.

Figure 4:
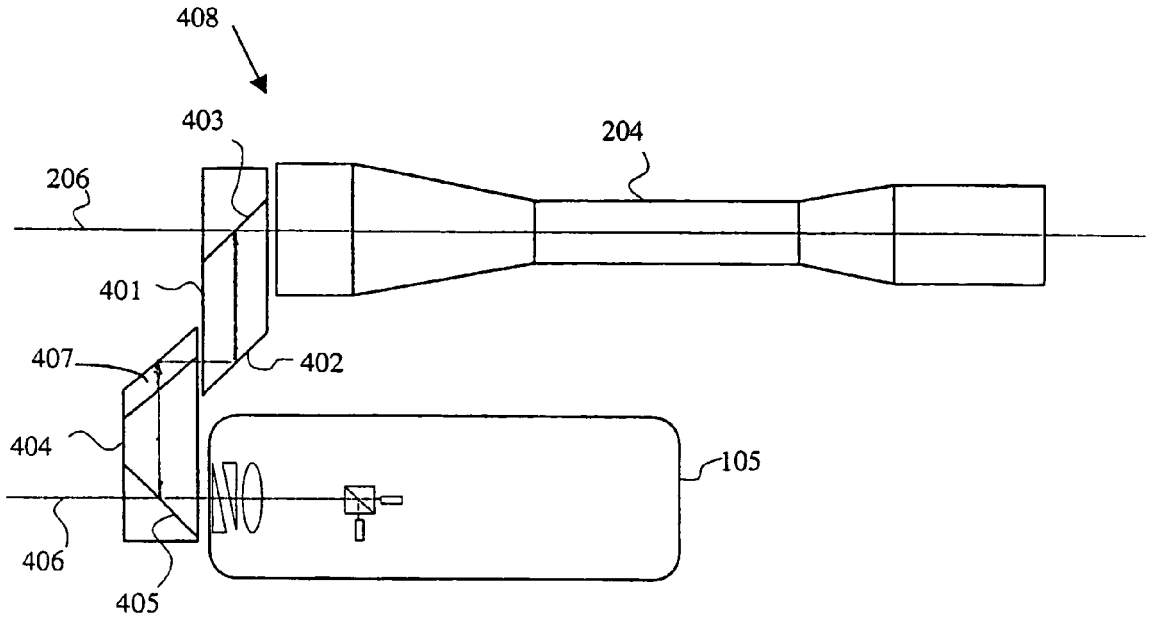
FIG. 4 shows yet another alternative aligning device.

FIG. 4 shows an alignment arrangement 408 that makes it possible to perform simulation and alignment simultaneously. As in the embodiments described earlier, a retroreflector prism 404 is arranged in the beam path in front of the simulating device 105. The retroreflector prism 404 has a mirror layer 405, which is the first surface beam from the simulating device strikes. The mirror layer is arranged so as to transmit IR radiation but reflect visible light, whereupon the simulation beam 406 passes straight through the mirror layer 405 while the alignment beam is simultaneously reflected from the roof prism 407 of the retroreflector prism 404. A periscope prism 401 is arranged in the beam path from the retroreflector prism 404. The periscope prism 401 contains twin surfaces 402, 403 that are inclined at the same angle and arranged at a distance from one another. The one surface 402 reflects visible light, while the second surface 403 is partially transparent to the visible light. The alignment beam from the retroreflector prism 404 first strikes the reflective surface 402 and then the partially transparent surface 403 for reflection thence toward the alignment scope, as described in connection with the preceding example. In addition, as in the preceding described example, the image 206 of the surroundings is visible through the surface 403. Thus, as in the previously described embodiments, the image 206 is visible through the alignment scope, with the projection of the alignment beam superimposed on said image. The alignment arrangement 408 consists in this example of the retroreflector prism 404, the periscope prism 401 and the alignment scope 204, wherein at least the retroreflector prism 404 and the periscope prism 401 are fixedly arranged in relation to one another. The retroreflector prism shifts the reflected beam in parallel a distance $d_1$, while the periscope prism shifts the beam in parallel a distance $d_2$, whereupon the total parallel shift is thus $d_1+d_2$.

A method for aligning the simulation axis of a simulating device with an appurtenant weapon sight by means of any of the aforedescribed alignment arrangements 207, 303 or 408 involves aiming the weapon at a sighting mark arranged at, e.g. a distance in excess of 1000 meters from the weapon, keeping the weapon stable so that the sight points at the sighting mark while the alignment scope is simultaneously used to determine the position of the projection of the alignment beam in the image 206, and adjusting the alignment axis, and thus also the simulation axis, by adjusting the optical wedges 103 so that the position of the projection of the alignment beam visible in the alignment scope is placed on the sighting mark.

In an alternative embodiment (not shown) of the alignment arrangement, the alignment beam is reflected in a direction that is not parallel with the simulation beam radiating from the simulating device 105. For example, it is possible in connection with the example shown in FIG. 2 to replace the partially transparent mirror 205 with a mirror arrangement disposed so as to reflect the alignment beam straight up from the shown instrument plane while the mirror arrangement simultaneously reflects the image 206 straight up from the shown instrument plane as well. In this example, the alignment scope 204 is arranged above the mirror and pointing down toward same.

The invention is not limited to the aforedescribed embodiment in which the simulation beam and the alignment beam from the simulator 105 are aimed along a common axis. It will be readily apparent to one skilled in the art that the invention will work equally well in an embodiment wherein the simulation and alignment beams leave the simulator 105 in a fixed and known angular relationship, which is compensated for so that the alignment beam entering the alignment scope is parallel with the simulation beam. The way in such compensation could be achieved by means of, e.g. optical wedges in the beam path will be obvious to one skilled in the art.

The invention claimed is:

1. An aligning device for a simulator arranged for firing and mounted on a weapon, comprising adjusting means and sighting means, wherein the weapon has aiming means arranged to indicate, within a first window, the aiming of the weapon in a target area, wherein the simulator is equipped with at least a first element arranged so as to emit an electromagnetic beam along a simulation axis, and the adjusting means is arranged so as to control the simulation axis to align the simulation axis with the aiming means, characterized in that it has means arranged so as to reflect visible light from the beam, and the sighting means for alignment is arranged so as to display a projection of the reflected light superimposed over an image of the target area in an alignment sight window, wherein the projected light is movable within the alignment sight window by means of the adjusting means in order to enable placement of the projection at a point at which the aiming means are aimed, wherein said first window and said alignment sight window are separate and independent, wherein a radial distance between the simulation axis and the alignment sight window is smaller than a distance between the simulation axis and the first window.

2. An aligning device according to claim 1, characterized in that the reflecting means are arranged so as to reflect the visible light along an axis parallel with the simulation axis.

3. An aligning device according to claim 2, characterized in that the sighting means include a first surface that is partially transparent to radiation within the visible wavelength spectrum and arranged so as to transmit the target area image to the sight window, and in that the first surface also comprises part of the reflecting means, wherein the surface is arranged so as to reflect at least a part of the visible light of the beam toward the sight window in a direction coincident with the axis parallel to the simulation beam.

4. An aligning device according to claim 3, characterized in that the reflecting means include a second surface arranged along the simulation axis and in such a way as to reflect light within at least a part of the visible wavelength spectrum.

5. An aligning device according to claim 4, characterized in that the first and the second surface are incorporated in a retro reflector prism.

6. An aligning device according to claim 2, characterized in that the reflecting means include at least one retro reflector prism.

7. An aligning device according to claim 1, characterized in that the sighting means include an element for magnifying the image displayed in the sight window.

8. An aligning device according to claim 1, characterized in that the sighting means include means for transferring the image displayed in the sight window to a display site.

9. An aligning device for a simulator arranged for firing and mounted on a weapon, comprising adjusting means and sighting means, wherein the weapon has aiming means arranged to indicate, within a first window, the aiming of the weapon in a target area, wherein the simulator is equipped with a first element arranged so as to emit an electromagnetic beam along a simulation axis, a second element arranged so as to generate an alignment beam along an alignment axis whose angle relative to the simulation axis is fixed and known, and wherein the adjusting means, during alignment of the simulation axis with the aiming means, collectively controls the alignment axis and the simulation axis so that said axes maintain their mutually fixed relationship during alignment, characterized in that it has means arranged to reflect the alignment beam and wherein the sighting means for alignment are arranged so as to display a projection of the reflected alignment beam superimposed over an image of the target area in an alignment sight window, wherein the projected alignment beam is movable within the alignment sight window by means of the adjusting means in order to enable placement of the projection at a point at which the aiming means are aimed, wherein said first window and said alignment sight window are separate and independent, wherein a radial distance between the simulation axis and the alignment sight window is smaller than a distance between the simulation axis and the first window.

10. A method for using an aligning device, comprising:

providing an aligning device for a simulator arranged for firing and mounted on a weapon, which weapon has aiming means arranged to indicate, within a first window, the aiming of the weapon in a target area, wherein the simulator is equipped with at least a first element arranged so as to emit an electromagnetic beam along a simulation axis, and adjusting means arranged so as to control the simulation axis to align the simulation axis with the aiming means, characterized in that it has means arranged so as to reflect visible light from the beam, and sighting means for alignment arranged so as to display a projection of the reflected light superimposed over an image of the target area in an alignment sight window, wherein the projected light is movable within the alignment sight window by means of the adjusting means in order to enable placement of the projection at a point at which the aiming means are aimed, wherein said first window and said alignment sight window are separate and independent, wherein a radial distance between the simulation axis and the alignment sight window is smaller than a distance between the simulation axis and the first window;

aligning the simulation axis with the aiming means, characterized in that the weapon is aimed at a target point in the target area while using the aiming means; and while the aim of the weapon is maintained, controlling the adjusting means so as to position the projection of the reflected light within the image in such a way that the projection essentially coincides with the point of impact.

11. An aligning device for a simulator mounted on a weapon containing an aiming device having an aiming axis, comprising:

a sighting device;

a simulation beam generator for generating a simulation beam;

an alignment beam generator for generating an alignment beam;

a beam splitter arranged to project a projected beam including one or both of said simulation beam and said alignment beam over a single beam axis; and a prism arranged to linearly and rotationally redirect said projected beam onto said aiming axis; wherein:

said aiming device is arranged to indicate, within a first window, the aiming of the weapon in a target area;

said sighting device is arranged to display a projection of the reflected light superimposed over an image of the target area in an alignment sight window;

said first window and said alignment sight window are separate and independent; and a radial distance between said beam axis and said alignment sight window is smaller than a distance between said beam axis and said first window.

12. The aligning device of claim 11, further comprising an adjusting device arranged to allow adjustment of said beam axis.

13. The aligning device of claim 12, wherein said adjusting device includes a lens and one or more optical wedges.

14. The aligning device of claim 11, wherein said prism includes a roof prism and a mirror offset at a same angle of inclination.

15. The aligning device of claim 11, wherein said aiming axis and said beam axis are nonparallel.

16. The aligning device of claim 11, wherein said prism is a pentaprism.

17. The aligning device of claim 11, wherein said prism is a retroreflector prism and further comprising a periscope prism.

* * * * *